US010598370B2

(12) United States Patent
Miyake et al.

(10) Patent No.: US 10,598,370 B2
(45) Date of Patent: Mar. 24, 2020

(54) MOUNTING PEDESTAL, LIGHT-EMITTING DEVICE, MOVING-BODY LIGHTING DEVICE, AND MOVING BODY

(71) Applicant: Panasonic Intellectual Property Management Co., Ltd., Osaka (JP)

(72) Inventors: Takahiro Miyake, Osaka (JP); Tomoyuki Nakano, Osaka (JP); Masahiro Kasano, Osaka (JP); Takashi Matsuda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 327 days.

(21) Appl. No.: 15/694,830

(22) Filed: Sep. 3, 2017

(65) Prior Publication Data

US 2018/0073718 A1 Mar. 15, 2018

(30) Foreign Application Priority Data

Sep. 13, 2016 (JP) ..... 2016-178940

(51) Int. Cl.

| | |
|---|---|
| ***F21V 29/76*** | (2015.01) |
| ***F21S 41/141*** | (2018.01) |
| ***F21S 41/143*** | (2018.01) |
| ***F21S 41/19*** | (2018.01) |
| ***F21S 41/29*** | (2018.01) |
| ***F21S 41/20*** | (2018.01) |
| ***F21S 45/47*** | (2018.01) |

(Continued)

(52) U.S. Cl.

CPC ..... *F21V 29/76* (2015.01); *F21S 41/143* (2018.01); *F21S 41/192* (2018.01); *F21S 41/285* (2018.01); *F21S 41/29* (2018.01); *F21S 45/47* (2018.01); *F21V 7/0066* (2013.01); *F21V 23/02* (2013.01); *H05B 33/22* (2013.01); *F21S 41/141* (2018.01); *F21Y 2115/10* (2016.08)

(58) Field of Classification Search

CPC ..... F21V 29/503; F21S 41/141; F21S 41/192; F21S 41/198; F21S 43/14; F21S 43/19; F21S 43/195; F21S 45/30; F21S 45/33

See application file for complete search history.

(56) References Cited

U.S. PATENT DOCUMENTS

| | | | | |
|---|---|---|---|---|
| 7,422,918 | B2 * | 9/2008 | Richard | H05K 1/0278 257/E27.12 |
| 7,701,144 | B2 * | 4/2010 | Tsukamoto | B60Q 1/0094 315/82 |

(Continued)

FOREIGN PATENT DOCUMENTS

| | | |
|---|---|---|
| EP | 1332957 A2 | 8/2003 |
| JP | 2002-33421 | 1/2002 |

(Continued)

*Primary Examiner* — Suezu Ellis

(74) *Attorney, Agent, or Firm* — Renner, Otto, Boiselle & Sklar, LLP

(57) ABSTRACT

A mounting pedestal is disposed on a wheeled vehicle and a light emitter is mounted on the mounting pedestal. The mounting pedestal includes a metal layer and an insulating layer stacked on the metal layer. The insulating layer has a major surface facing in a direction of travel of the wheeled vehicle and a heat escape port in which solder that joins the light emitter and the metal layer is disposed. The mounting pedestal has a step which arranges the major surface into a plurality of major surfaces.

18 Claims, 10 Drawing Sheets

(51) Int. Cl.

| | |
|---|---|
| ***H05B 33/22*** | (2006.01) |
| ***F21V 7/00*** | (2006.01) |
| ***F21V 23/02*** | (2006.01) |
| *F21Y 115/10* | (2016.01) |

(56) References Cited

U.S. PATENT DOCUMENTS

2008/0253145 A1* 10/2008 Biarne ..... H05K 1/189 362/548
2009/0009977 A1* 1/2009 Enomoto ..... H05K 1/189 361/749
2009/0103295 A1* 4/2009 Wang ..... F21K 9/00 362/234
2010/0214799 A1* 8/2010 Ohmi ..... B60Q 1/2696 362/545
2011/0228536 A1* 9/2011 Im ..... F21S 41/192 362/249.06
2014/0063805 A1* 3/2014 Song ..... F21V 29/50 362/249.01
2014/0140062 A1* 5/2014 Choi ..... F21S 2/005 362/249.01
2014/0218954 A1* 8/2014 Yoon ..... H01L 33/62 362/546
2016/0009216 A1* 1/2016 Song ..... F21V 19/00 362/516
2016/0031361 A1* 2/2016 Lauvernier ..... H05K 1/0284 362/516

FOREIGN PATENT DOCUMENTS

| | | |
|---|---|---|
| JP | 4005377 | 8/2003 |
| JP | 2008-277442 | 11/2008 |
| JP | 2012-76573 | 4/2012 |
| JP | 2013-143479 | 7/2013 |
| JP | 2016-40779 | 3/2016 |

* cited by examiner

MOUNTING PEDESTAL, LIGHT-EMITTING DEVICE, MOVING-BODY LIGHTING DEVICE, AND MOVING BODY

CROSS REFERENCE TO RELATED APPLICATION

This application claims the benefit of priority of Japanese Patent Application Number 2016-178940 filed on Sep. 13, 2016, the entire content of which is hereby incorporated by reference.

BACKGROUND

1. Technical Field

The present disclosure relates to a mounting pedestal, a light-emitting device including a mounting pedestal, a moving-body lighting device including a mounting pedestal, and a moving body including a mounting pedestal.

2. Description of the Related Art

A conventional mounting pedestal used in a wheeled vehicle (one example of the moving body) includes a stepped pedestal (one example of the mounting pedestal) and a light-emitting diode (one example of the light source) mounted on the stepped pedestal (for example, see Japanese Patent No. 4005377).

With this mounting pedestal, light-emitting diodes can be inclined in the anteroposterior direction of the wheeled vehicle as a result of the wheeled vehicle tail light including a stepped pedestal, making it possible to diversify the shape of the tail light.

SUMMARY

However, there is a demand for a mounting pedestal that both increases the design freedom of the moving body and efficiently dissipates heat generated by the light source, so as to be applicable to various moving bodies.

In light of this, the present disclosure has an object to provide a mounting pedestal, light-emitting device, moving-body lighting device, and moving body capable of both increasing the design freedom of a moving body and efficiently dissipating heat generated by a light source.

In order to achieve the above object, according to one aspect of the present invention, a mounting pedestal used in a moving body and on which a light emitter is mounted, includes a metal layer and an insulating layer stacked on the metal layer. The insulating layer has a major surface facing in a direction of travel of the moving body and a heat escape port in which a joining component that joins the light emitter and the metal layer is disposed, and the mounting pedestal has a step which arranges the major surface into a plurality of major surfaces.

According to the present disclosure, it is possible to both increase the design freedom of a moving body and efficiently dissipate light source heat.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

The following describes an embodiment with reference to the drawings. Note that the embodiment described below shows a specific example of the present disclosure. The numerical values, shapes, materials, elements, the arrangement and connection of the elements, etc., indicated in the following embodiment are mere examples, and therefore do not intend to limit the inventive concept. Therefore, among elements in the following embodiment, those not recited in any of the independent claims defining the broadest inventive concept are described as optional elements.

Moreover, "approximately" means, for example in the case of "approximately the same," not only exactly the same, but what would be recognized as essentially the same as well. The same also applies to the term "vicinity".

Note that the figures are schematic diagrams and do not necessarily depict precise illustrations. Additionally, like reference signs indicate like elements in the figures. As such, overlapping explanations of like elements are omitted or simplified.

Embodiment

Hereinafter a mounting pedestal, light-emitting device, moving-body lighting device, and moving body according to an embodiment of the present disclosure will be described.

(Configuration)

First, mounting pedestal 200; light-emitting devices 11 and 12 each including mounting pedestal 200 mounted with light emitters 50; headlight 103 including mounting pedestal 200; and a moving body including mounting pedestal 200 according to this embodiment will be described with reference to FIG. 1 through FIG. 9.

Figure 1:
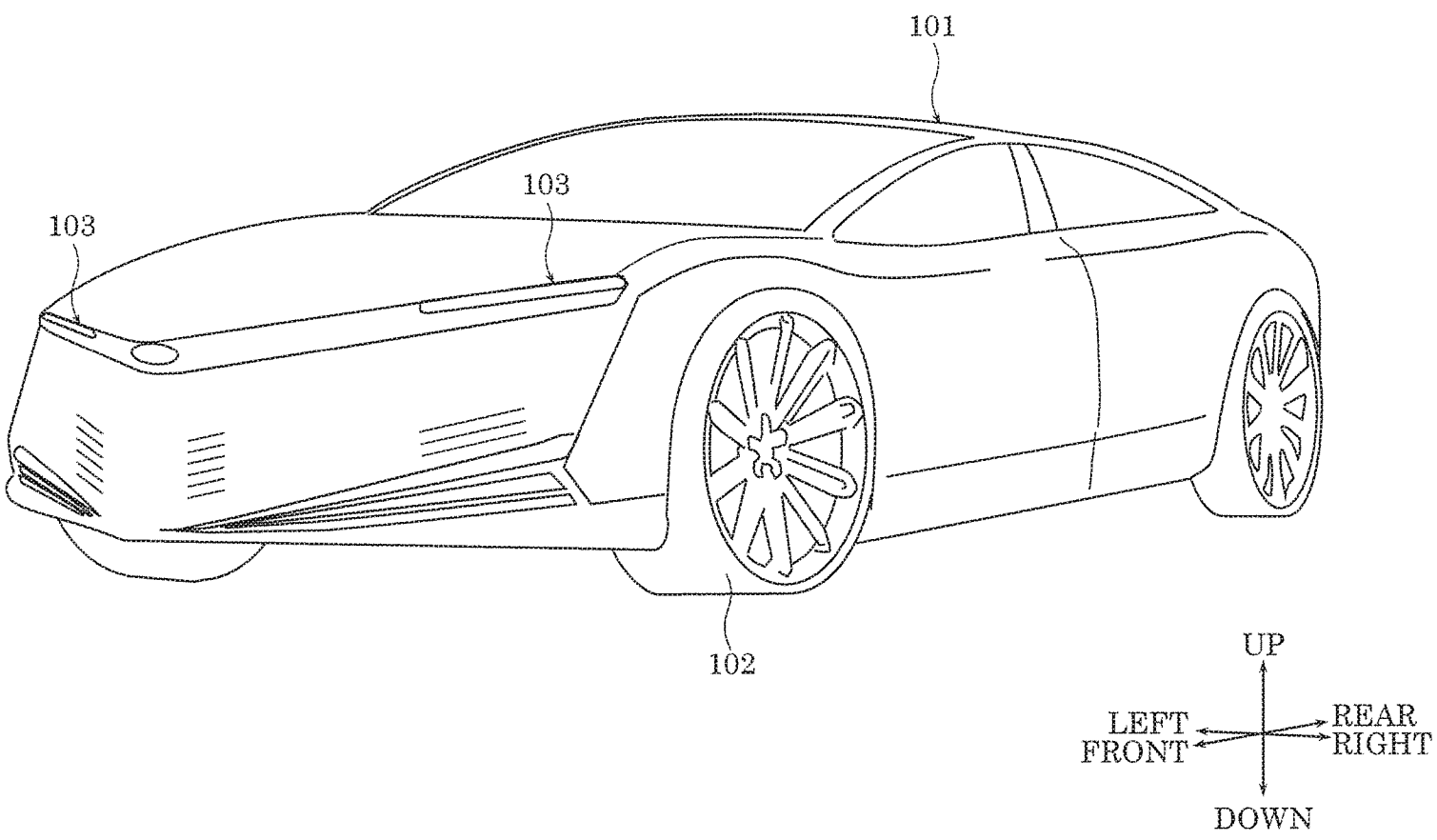
FIG. 1 is a perspective view of a moving body according to an embodiment.
Figure 2:
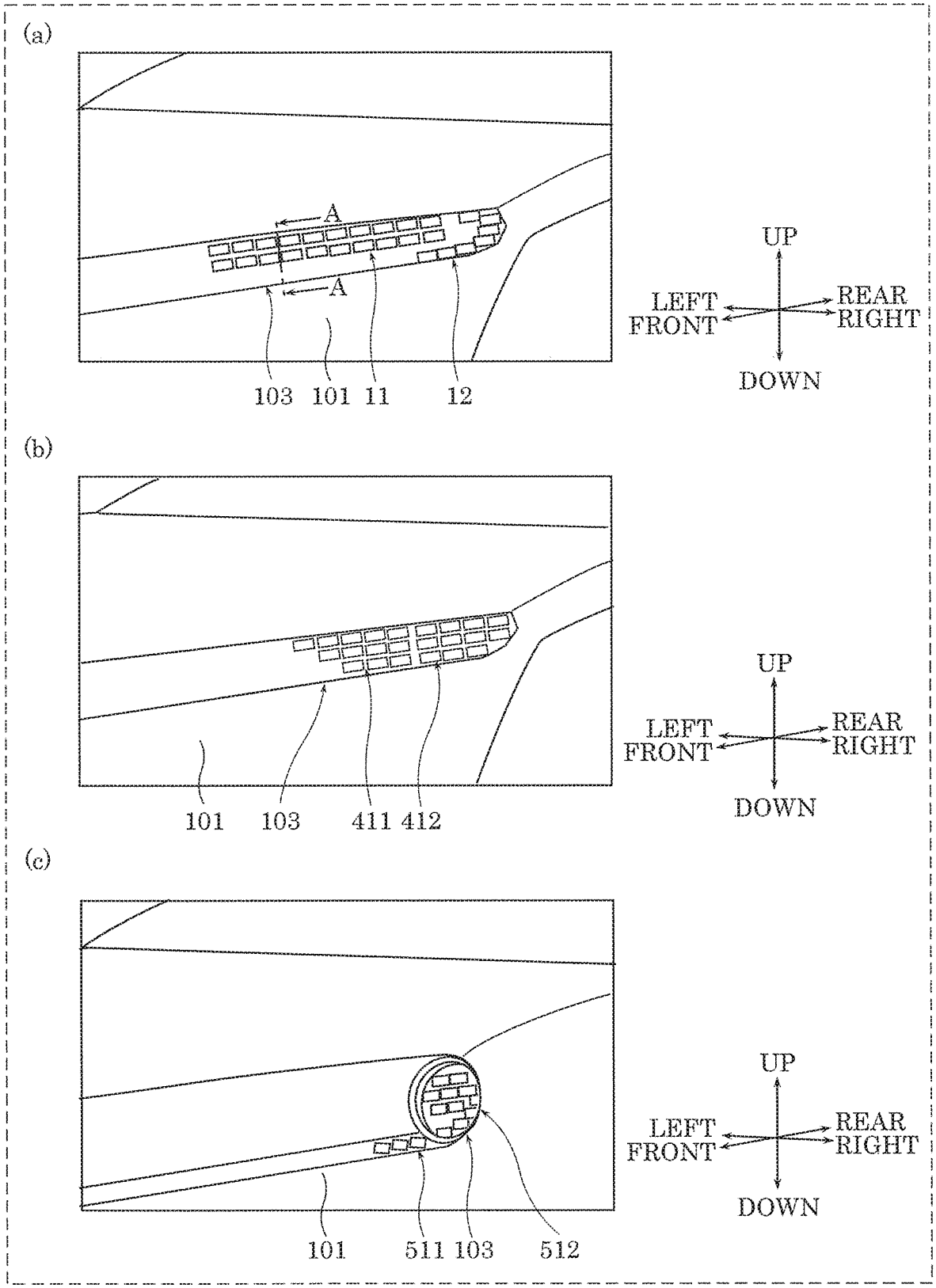
In FIG. 2, (a) illustrates an enlarged partial perspective view of a headlight of a moving body according to an embodiment, (b) illustrates an enlarged partial perspective view of a headlight of a moving body according to a variation, and (c) illustrates an enlarged partial perspective view of a headlight of a moving body according to a variation.
Figure 3:
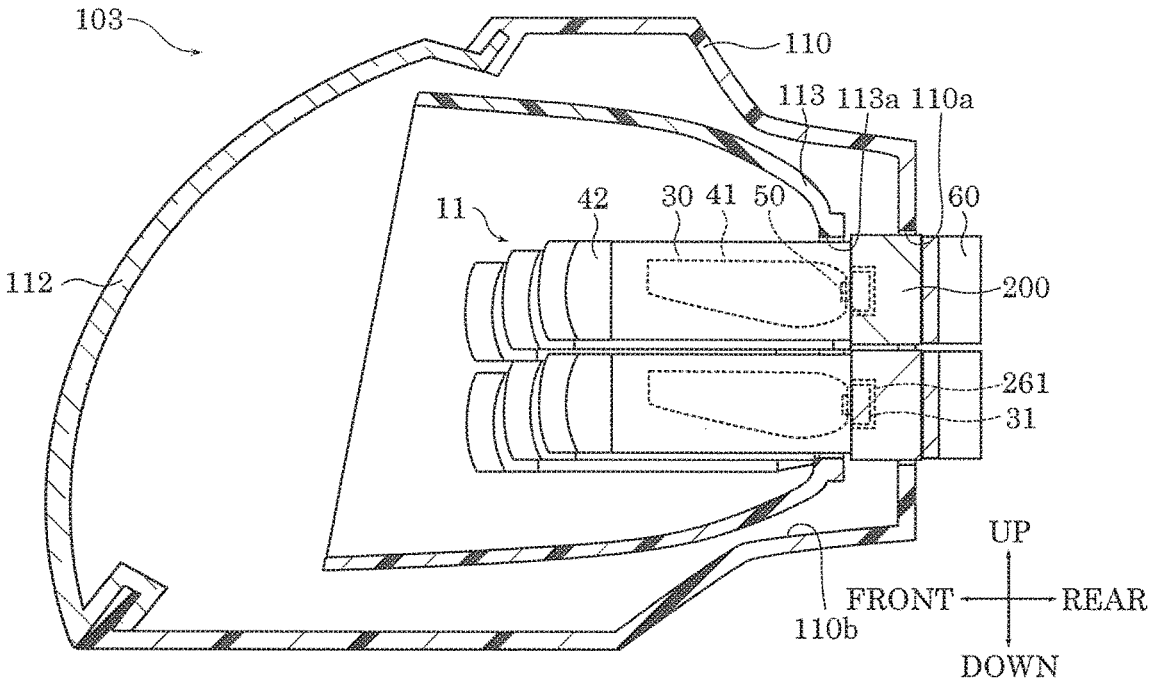
FIG. 3 is a cross sectional view of a headlight of a moving body according to an embodiment.
Figure 4:
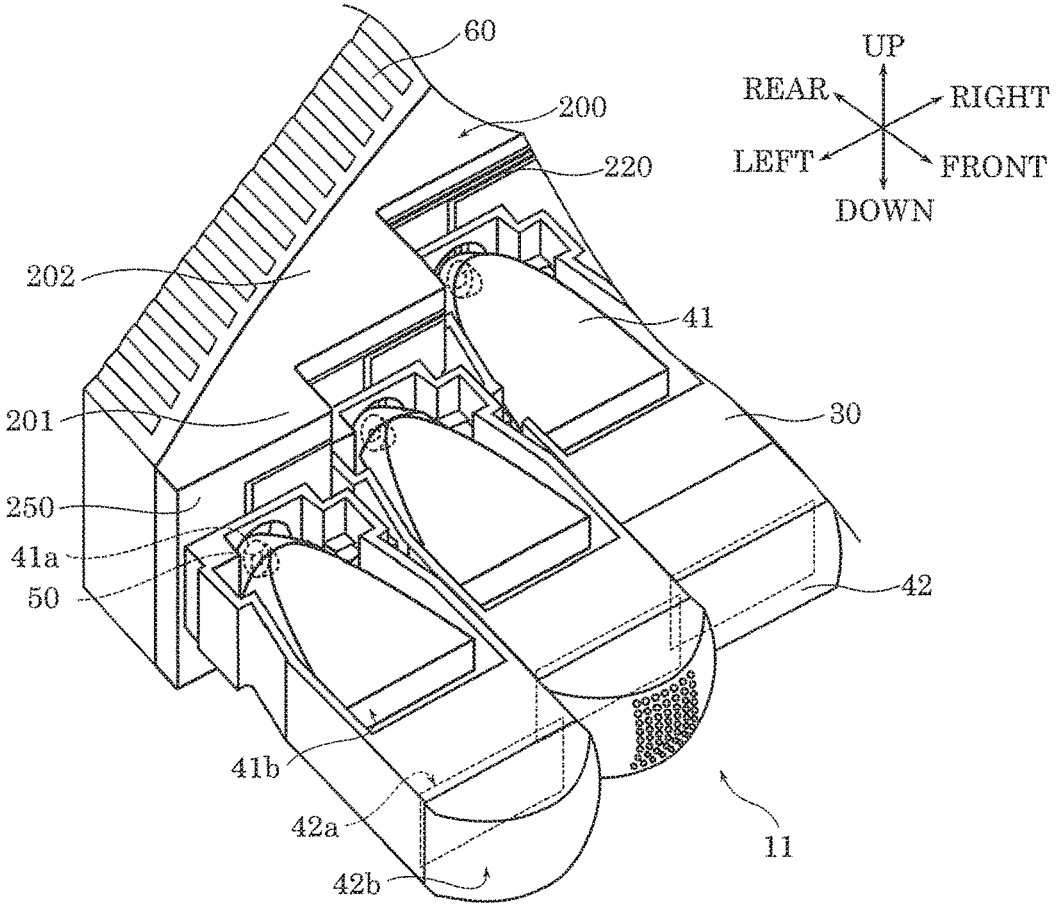
FIG. 4 is a perspective view of a high-beam light-emitting device according to an embodiment.
Figure 5:
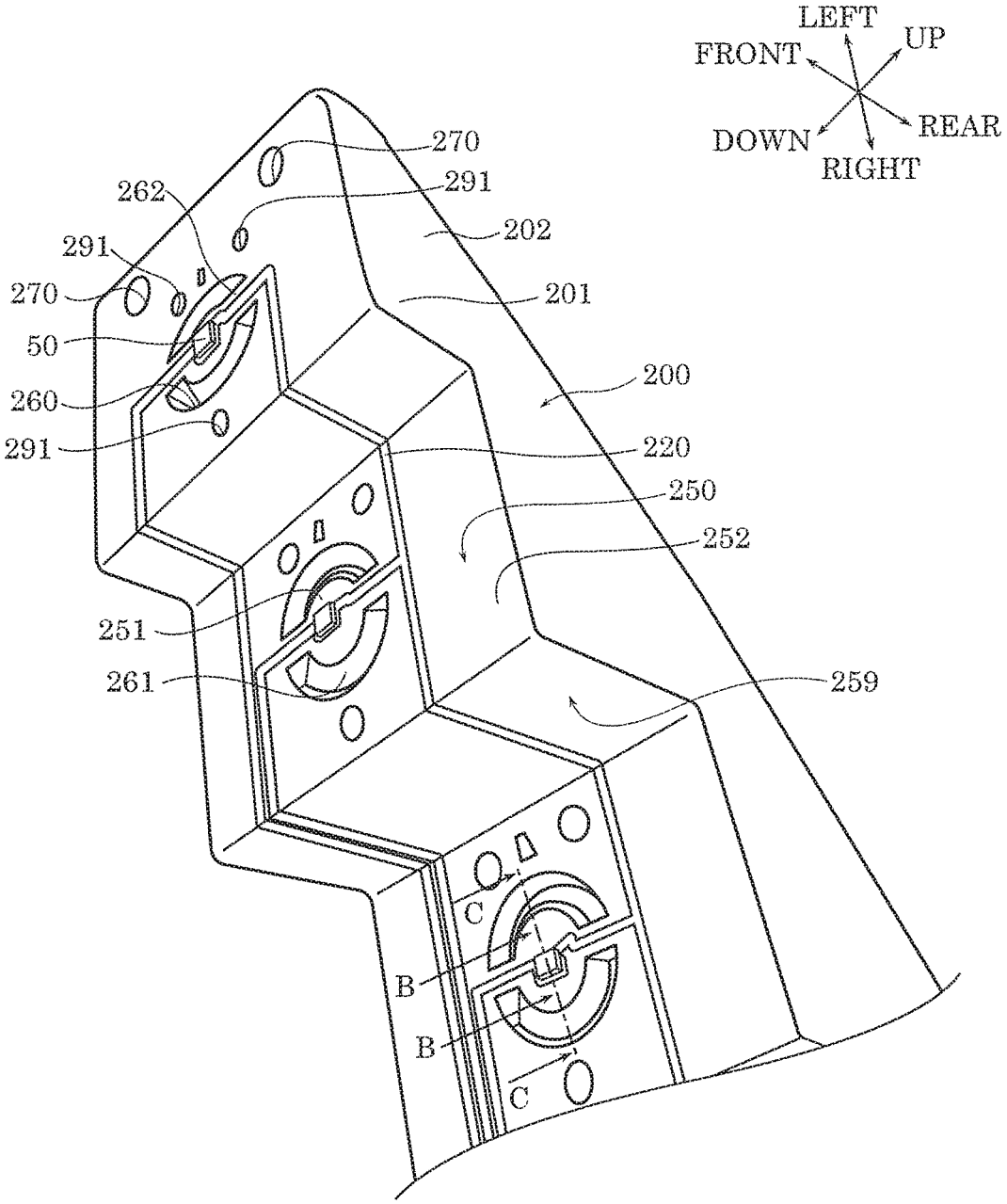
FIG. 5 is a perspective view of a light emitter mounted to a mounting pedestal according to an embodiment.
Figure 6:
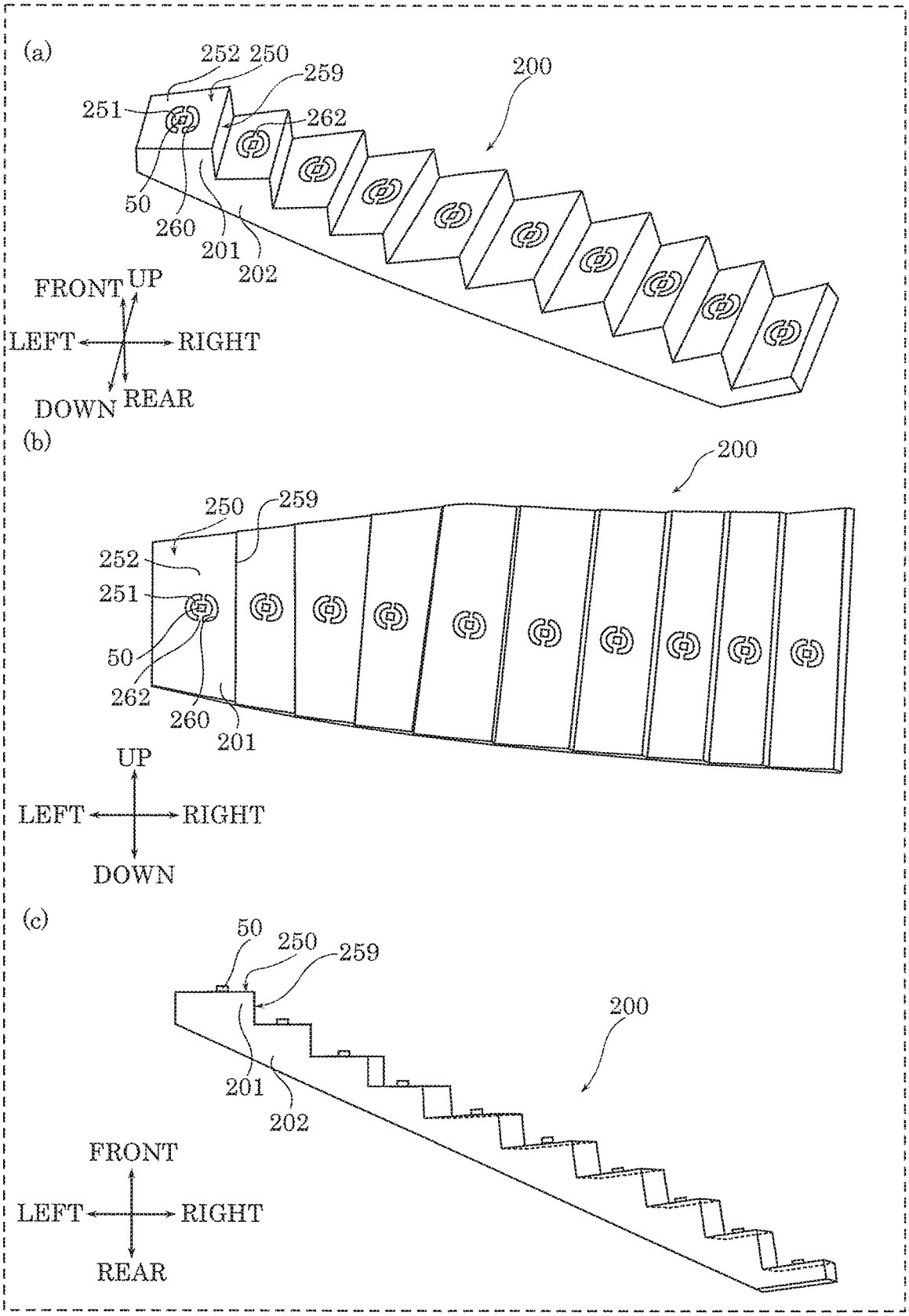
In FIG. 6, (a) illustrates a perspective view of a high-beam mounting pedestal and a light emitter mounted thereto according to an embodiment, (b) illustrates a front view of a high-beam mounting pedestal and a light emitter mounted thereto according to an embodiment, and (c) illustrates a side view of a high-beam mounting pedestal and a light emitter mounted thereto according to an embodiment.
Figure 7:
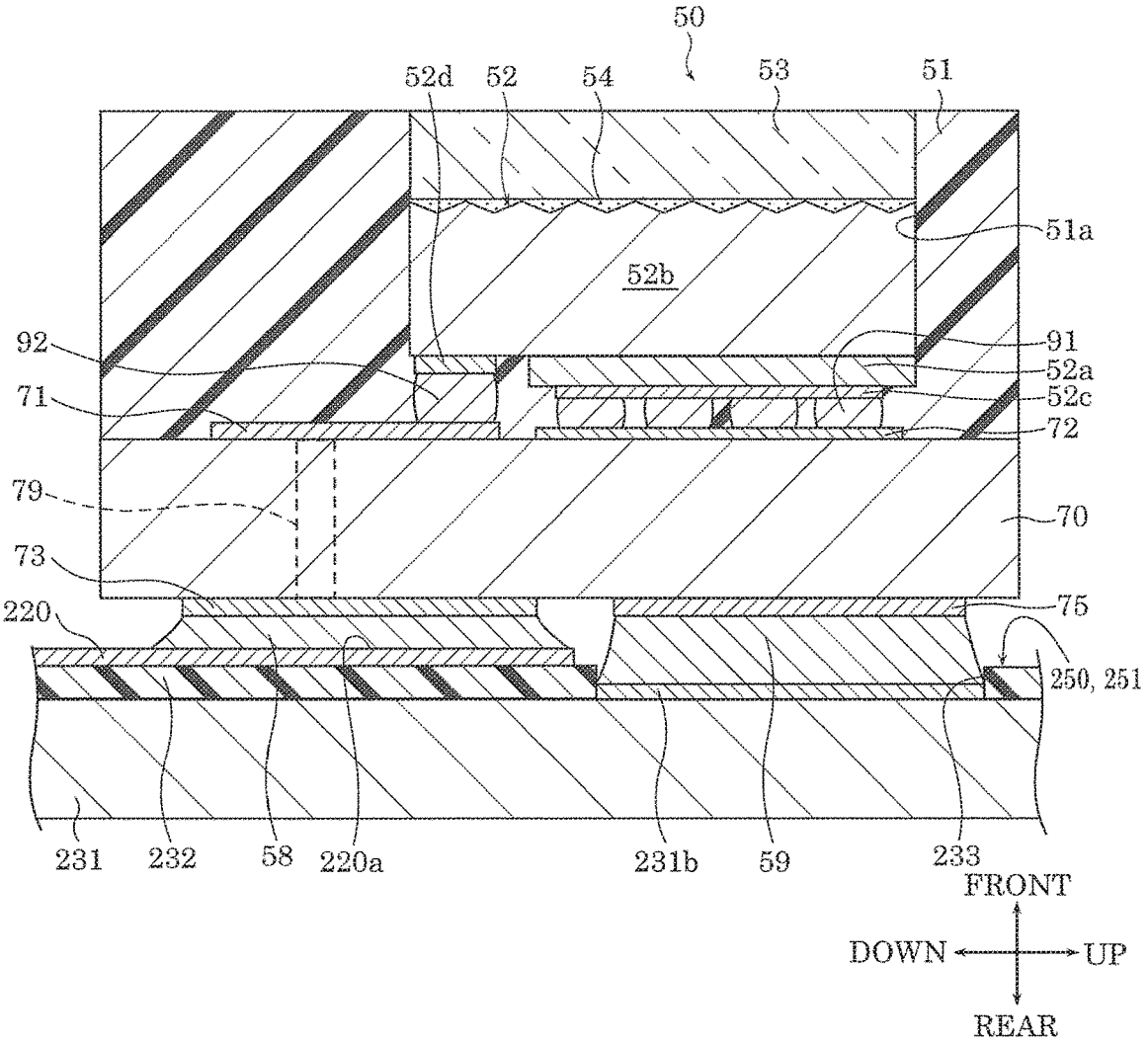
FIG. 7 is an enlarged partial cross sectional view of a mounting pedestal and a light emitter mounted thereto according to an embodiment.
Figure 8:
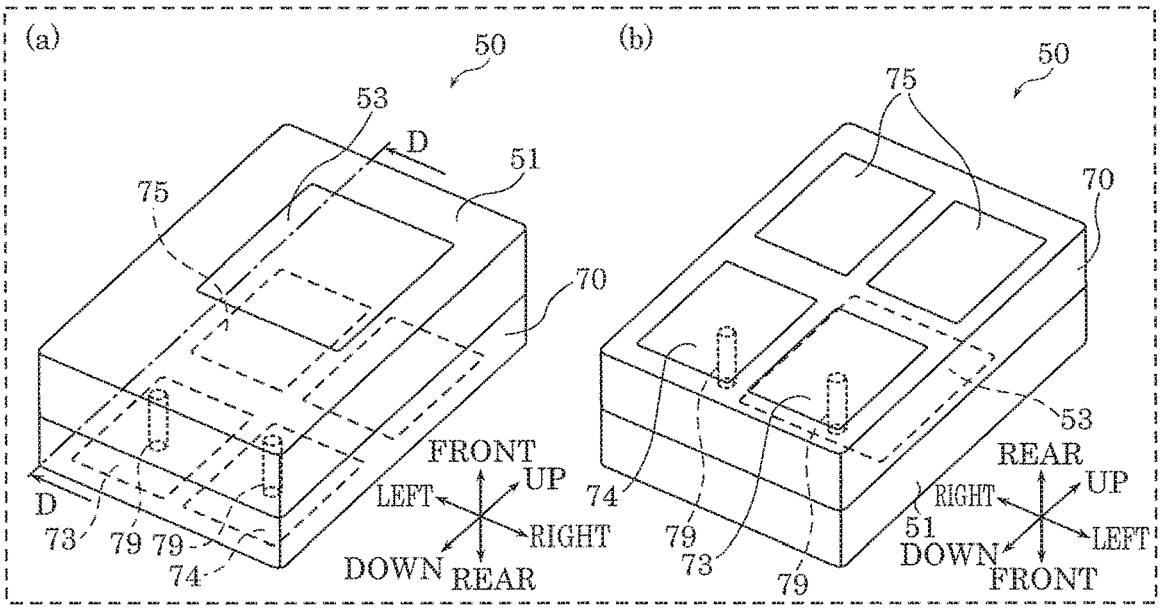
In FIG. 8, (a) illustrates a perspective view of the front surface of a light emitter according to an embodiment, and (b) illustrates a perspective view of the rear surface of a light emitter according to an embodiment.
Figure 9:
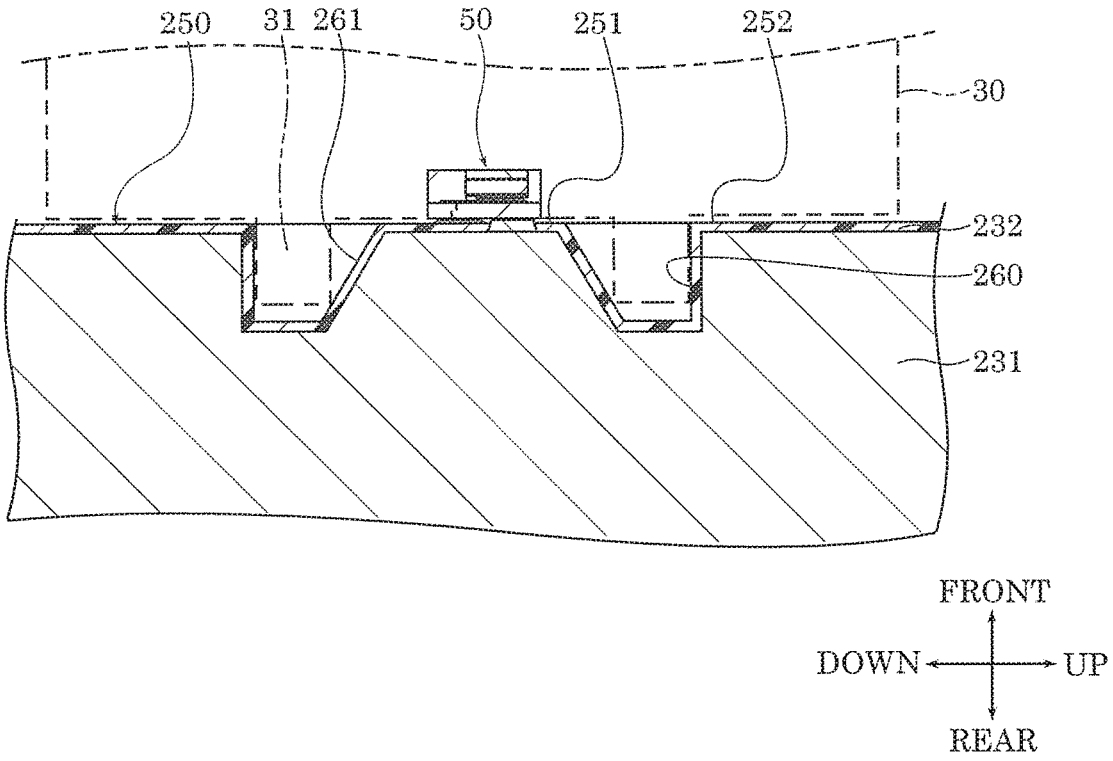
FIG. 9 is an enlarged partial cross sectional view of a mounting pedestal and a light emitter mounted thereto according to an embodiment.

FIG. 1 is a perspective view of the moving body according to this embodiment. In FIG. 2, (a) illustrates an enlarged partial perspective view of headlight 103 of the moving body according to this embodiment. FIG. 3 is a cross sectional view of headlight 103 of the moving body according to this embodiment. FIG. 4 is a perspective view of a high-beam light-emitting device 11 according to this embodiment. FIG. 5 is a perspective view of light emitter 50 mounted to mounting pedestal 200 according to this embodiment. In FIG. 6, (a) illustrates a perspective view of a high-beam mounting pedestal 200 and light emitter 50 mounted thereto according to this embodiment. In FIG. 6, (b) illustrates a front view of the high-beam mounting pedestal 200 and light emitter 50 mounted thereto according to this embodiment. In FIG. 6, (c) illustrates a side view of the high-beam mounting pedestal 200 and light emitter 50 mounted thereto according to this embodiment. FIG. 7 and FIG. 9 are enlarged partial cross sectional views illustrating mounting pedestal 200 and light emitter 50 mounted thereto according to this embodiment. In FIG. 8, (a) illustrates a perspective view of the front surface of light emitter 50 according to an embodiment. In FIG. 8, (b) illustrates a perspective view of the rear surface of light emitter 50 according to an embodiment.

Note that the cross section in FIG. 3 is taken at line A-A in (a) in FIG. 2. Also, in mounting pedestal 200 illustrated in FIG. 6, electrical line 220, screw holes 291, connector 270, etc., are omitted from the drawing. In mounting pedestal 300 illustrated in FIG. 10 as well, similar to mounting pedestal 200, electrical line 220, screw hole 291, connector 270, etc., are omitted from the drawing. The cross section in FIG. 7 is taken at line B-B in FIG. 5, and more specifically, is taken at line D-D in (a) of FIG. 8 illustrating light emitter 50. The cross section in FIG. 9 is taken at line C-C in FIG. 5.

In FIG. 1, front, rear, left, right, up, and down directions are illustrated. The headlight 103 side of the moving body is defined as the front of the moving body, the opposite side is defined as the rear of the moving body, the side of the moving body on which the right headlight 103 is located is defined as the right side of the moving body, the opposite side is defined as the left side of the moving body, the side of the moving body on which wheel 102 of wheeled vehicle 100 is located is defined as the bottom side of the moving body, the opposite side is defined as the top side of the moving body. The directions illustrated in FIG. 1 correspond to the directions illustrated in all subsequent figures. Note that in FIG. 1, the up, down, left, right, front, and rear directions are not limited to the example given, and may differ depending on application. The same applies to subsequent figures.

As illustrated in FIG. 1, wheeled vehicle 100 (one example of the moving body) includes wheeled vehicle body 101, four wheels 102, and headlights 103 (one example of the moving-body lighting device) including mounting pedestal 200. The moving body is, for example, a wheeled vehicle, a train, an aircraft, or a watercraft.

Wheeled vehicle body 101 includes four wheels 102 and a plurality of headlights 103. In this embodiment, wheeled vehicle 101 includes two headlights 103 in the front end of wheeled vehicle body 101 so as to illuminate an object located in the direction of travel of wheeled vehicle 100. One example of "direction of travel" is, for example, forward. Examples of the object include a road, a wall, and a person.

The two headlights 103 are disposed so as to have bilateral symmetry. As illustrated in (a) in FIG. 2 and in FIG. 3, one headlight 103 includes housing 110, front lens 112, reflector 113, two high-beam light-emitting devices 11, and low-beam light-emitting device 12. Here, mainly the high-beam light-emitting device 11 will be discussed.

Housing 110 has a bowl shape with an open front, and front lens 112 is joined to the open front end of housing 110 via a sealing component. Front lens 112 is a lens through which light emitted by headlight 103 passes, and controls the distribution of the exiting light. The rear end of housing 110 includes insertion opening 110*a*, and when installed, light-emitting device 11 is inserted through insertion opening 110*a*. Note that light-emitting device 12 is also inserted through insertion opening 110*a*.

Reflector 113 is a reflective mirror that controls the distribution of light emitted by light-emitting devices 11 and 12 such that the light is emitted in the direction of travel. Reflector 113 is supported by housing 110, and may adjust the optical axis of light emitter 50 (optical axis of light source 52) up and down. The rear end of reflector 113 includes insertion opening 113*a*, and when installed, light-emitting devices 11 and 12 are inserted through insertion opening 113*a*.

Housing space 110*b* elongated in the left and right directions is formed between housing 110 and front lens 112, and high-beam light-emitting device 11 and low-beam light-emitting device 12 are disposed in housing space 110*b*.

As illustrated in FIG. 4, high-beam light-emitting device 11 includes mounting pedestal 200, a plurality of light emitters 50, a plurality of lens tubes 30, a plurality of first light-transmissive components 41, a plurality of second light-transmissive components 42, and heat dissipating fins 60. Here, one of the plurality of light-emitting devices 11 will be described, and description of overlapping configurations will be omitted. Moreover, when the same component is included in plurality in light-emitting device 11, the component will be described in singular form, and description of overlapping configurations will be omitted.

Mounting pedestal 200 is provided in housing 110 so as to orientate the optical axes of the plurality of mounted light emitters 50 in a desired direction. Mounting pedestal 200 has steps 201.

As illustrated in FIG. 5, the plurality of steps 201 formed in the front give mounting pedestal 200 a stepped structure. Mounting pedestal 200 is elongated in the alignment direction of major surfaces 250 (in this embodiment, left and right directions), and is curved. In this embodiment, steps 201 on mounting pedestal 200 ascend in the direction of travel, but the arrangement of mounting pedestal 200 is not limited to this example.

In a direction approximately from left to right and a direction approximately from the front to the rear, mounting pedestal 200 extends in an elongated shape, and has a stepped structure defined by the plurality of steps 201. The plurality of steps 201 are arranged in the alignment direction. In this embodiment, mounting pedestal 200 is curved, but mounting pedestal 200 may be formed in a straight line. Moreover, as illustrated in (a) in FIG. 6, in this embodiment, nine steps 201 are formed, but the number of steps 201 is not particularly limited. For example, a single step 201 is acceptable.

Steps 201 each include major surface 250 facing in the direction of travel of wheeled vehicle 100 and step side surface 259 approximately perpendicular to major surface 250. Steps 201 are formed by alternately forming major surface 250 and step side surface 259.

In this embodiment, as illustrated in (b) in FIG. 6, in a front view, major surfaces 250 each have a rectangular planar shape, and the shape of each major surface 250 is different. Note that in this embodiment, major surfaces 250 are rectangular in shape, but this example is not limiting. For example, major surfaces 250 may be circular, polygonal, any combination thereof, or any other shape.

Each major surface 250 may be approximately parallel to a plane approximately perpendicular to the direction of travel, and may be a plane that intersects a plane approximately perpendicular to the direction of travel. As illustrated in (c) in FIG. 6, in mounting pedestal 200, in order in the direction of travel, each major surface 250 is gradually closer to being parallel to a plane approximately perpendicular to the direction of travel than the preceding major surface 250. In this embodiment, the forwardmost major surface 250 (major surface 250 disposed furthest in the direction of travel) is approximately parallel to a plane approximately perpendicular to the direction of travel. In other words, in mounting pedestal 200, in a front view of major surfaces 250 (when viewing major surfaces 250 from the front looking rearward), in order in the direction of travel, each major surface 250 is closer to being parallel to a plane approximately perpendicular to the direction of travel than the preceding major surface 250 In this case, when light emitters 50 are mounted to mounting pedestal 200, in a front view of major surfaces 250, in order in the direction of travel, each optical axis of light emitters 50 is closer to being parallel to the direction of travel than the optical axis of a previous light emitter 50. Note that in this embodiment, the forwardmost major surface 250 is described as the reference for being approximately parallel to a plane approximately perpendicular to the direction of travel, but another major surface 250 among the major surfaces 250 may be used as the reference.

As illustrated in FIG. 5, each major surface 250 includes depressions 260 that support lens tube 30. In this embodiment, two discrete depressions 260, each of which has a circular arc front view shape, are structured so as to collectively surround a surrounding region of part of light emitter 50. In this embodiment, bridges 262 are formed in the region between the two depressions 260. Note that in this embodiment, depressions 260 are formed as depressions having a bottom, but depressions 260 may be formed as through-holes.

In this embodiment, each depression 260 has inclined surface 261 inclined such that depression 260 gradually narrows from the opening of depression 260 toward the bottom of depression 260. Stated differently, each depression 260 is formed such that depression 260 gradually narrows from the opening of depression 260 in a direction opposite the direction of travel. In this embodiment, inclined surface 261 is formed on the side surface of depression 260 that is adjacent to first planar surface 251 (to be described later), but inclined surface 261 may be formed on the side surface of depression 260 that is adjacent to second planar surface 252 (to be described later). Note that as a substitute for depression 260, a protrusion may be formed that has an inclined surface inclined such that the protrusion gradually narrows in outer diameter from major surface 250 toward the tip end of the protrusion.

Each major surface 250 includes first planar surface 251 and second planar surface 252.

First planar surface 251 is a surface on which light source 52 of light emitter 50 is mounted, a surface that is partially surrounded by depressions 260, and a surface on which electrical line 220, which includes power supply surface 220*a* on which light source 52 is disposed, extends. Second planar surface 252 comprises the surface of major surface 250 excluding first planar surface 251 and depressions 260, and is flush with first planar surface 251.

Electrical line 220 is an electrical line that applies power to light source 52, and is provided so as to hug major surface 250 and step side surface 259. Electrical line 220 extends across first planar surface 251 from second planar surface 252 to second planar surface 252. More specifically, electrical line 220 extends from the area of second planar surface 252 that is on the upper side of the outer perimeter of depression 260 to, in the listed order, the surface in front of the upper bridge 262 (which is part of second planar surface 252), first planar surface 251, the surface in front of the lower bridge 262 (which is part of second planar surface 252), and the area of second planar surface 252 that is on the lower side of the outer perimeter of depression 260. In other words, since first planar surface 251 and second planar surface 252 are flush, electrical line 220 is formed in an approximately straight line.

Each side surface may be a planar surface that is parallel to a vertical direction, and, alternatively, may be a planar surface that intersects a vertical direction. More specifically, in mounting pedestal 200, in order in the direction of travel, each side surface may be closer to being parallel to a vertical direction than the preceding side surface. In this embodiment, the forwardmost (furthest in the direction of travel) side surface is approximately parallel to a vertical direction.

A plurality of screw holes 291 for inserting screws are formed in mounting pedestal 200. Moreover, mounting pedestal 200 includes, at least one end (one example of the end region), connector 270 connectable to an adjacent mounting pedestal 200. Connector 270 may be a hole in which a connecting component such as screw is inserted, and may have a known connecting structure; so long as it is capable of connecting another mounting pedestal 200, the method used is not limited. In this embodiment, mounting pedestals include low-beam mounting pedestal 300 and two high-beam mounting pedestals 200, and these may be connected together by connectors 270. Moreover, a plurality of low-beam mounting pedestals 300 and a plurality of high-beam mounting pedestals 200 may be provided.

Heat dissipating fins 60 are disposed on the rear surface (surface on the rear side) of mounting pedestal 200, cut out in a direction approximately perpendicular to the alignment direction. In other words, heat dissipating fins 60 are flat plate-shaped fins that extend in a vertical direction (which is, in this embodiment, a direction approximately perpendicular to the alignment direction). Note that heat dissipating fins 60 may be integrally formed with mounting pedestal 200, or may be a separate component connected to mounting pedestal 200. Moreover, heat dissipating fins 60 may further be cut out in the alignment direction.

As illustrated in FIG. 4, ribs 202 are disposed on the rear surface of mounting pedestal 200, in positions corresponding to steps 201. Ribs 202 give the rear surface of mounting pedestal 200 an approximately planar surface. In this embodiment, ribs are formed so as to give the rear surface of mounting pedestal 200 an approximately planar surface, but may give the rear surface of mounting pedestal 200 a stepped structure corresponding to steps 201, and may give the rear surface of mounting pedestal 200 a curved surface. Note that ribs 202 are formed in the corners of a stepped structure that corresponds to steps 201, but this configuration is not absolutely necessary. When ribs 202 are not provided in the corners, the rear surfaces of major surfaces 250 and the rear surfaces of step side surfaces 259 define corners.

Examples of the material used for mounting pedestal 200 include, but are not limited to, metal, ceramic, and resin. Examples of the material used for a ceramic pedestal include aluminum oxide and aluminum nitride. Examples of the material used for a metal pedestal include aluminum alloy, iron alloy, and copper alloy having an insulating layer of insulating film formed on the rear surface thereof. Examples of the material used for a resin pedestal include glass epoxy.

In this embodiment, mounting pedestal 200 is a pedestal made of aluminum nitride having, as illustrated in FIG. 7, insulating layer 232 with insulating properties formed on the rear surface and having electrical line 220 (one example of the electrical line) patterned into a matrix pattern using, for example, a plating method. Power supply surface 220*a* (metal pad) for electrically connecting with light emitter 50 is formed on electrical line 220. When a plurality of light sources 52 are formed into a single package, the patterning for the electrical lines is designed so as to allow for series or parallel chip-to-chip connection.

Mounting pedestal 200 includes metal layer 231 and insulating layer 232 that is stacked on metal layer 231 and defines major surfaces 250. Metal layer 231 is formed of, for example, an aluminum nitride material. Electrical line 220 is formed on major surfaces 250 defined by insulating layer 232, and spaces are provided on major surfaces 250 for placing light sources 52. In each of these spaces, heat escape port 233 that communicatively connects major surface 250 to metal layer 231 is formed. Stated differently, heat escape port 233 in which solder 59 for joining light source 52 and metal layer 231 is disposed is formed in insulating layer 232. An electroless nickel is used for plated thin film layer 231*b*, but another metal may be used. Moreover, heat escape port 233 is disposed offset from power supply surface 220*a* in an approximately horizontal direction (upward). Plated thin film layer 231 may be copper plating, may have a stacked structure configured of copper plating plated on nickel plating, and may be alloy plating of nickel and copper.

Light emitters 50 and major surfaces 250 of steps 201 correspond one-to-one. In this embodiment, in a front view, each light source 52 has a 0.8 mm by 0.8 mm square shape. Moreover, in this embodiment, each light source 52 is disposed in the vicinity of an approximately central region of major surface 250 so as to emit white light in the direction of travel of wheeled vehicle 100.

Light emitter 50 includes reflective resin 51, light source 52, phosphor 53, light-transmissive resin 54, and metal pedestal 70. In this embodiment, reflective resin 51, light source 52, phosphor 53, light-transmissive resin 54, metal pedestal 70, etc., form an LED package.

Reflective resin 51 is a white silicone resin added with a light reflective material such as titanium oxide. Reflective resin 51 is formed so as to surround the surrounding region of light source 52 and phosphor 53, and includes housing region 51*a* formed as a depression so as to house light source 52 and phosphor 53. Light source 52 and phosphor 53 are stacked in this order on the bottom of housing region 51*a*. Note that phosphor 53 is flush with the front surface of reflective resin 51, but phosphor 53 may protrude beyond reflective resin 51.

Note that in the manufacturing of light emitter 50, a dam surrounding light emitter 50 on mounting pedestal 200 may be formed to hold back reflective resin 51.

Light source 52 is a flip-chip mounted LED element directly connected face-down, and in this embodiment, is a blue light source that emits blue light. As illustrated in FIG. 6, light emitters 50 are disposed on mounting pedestal 200 such that each light emitter 50 further in the direction of travel has an optical axis that forms a smaller (more acute) angle with the direction of travel than the optical axis of a preceding light emitter 50.

As illustrated in FIG. 7, light source 52 is disposed such that its LED semiconductor layer 52*b* end faces the front surface of metal pedestal 70. For example, anode electrode 52*c* (p electrode bump) and cathode electrode 52*d* (n electrode bump) are arranged in an array on the mounting surface of light source 52. In this embodiment, light source 52 includes light-emitting layer 52*a*, LED layer 52*b*, anode electrode 52*c* and cathode electrode 52*d*.

Light-emitting layer 52*a* is configured of, for example, a nitride semiconductor such as InGaN, and in one example, has a stacked structure configured of a p-type layer, an active layer, and an n-type layer stacked in this order. Anode electrode 52*c* is formed on the rear surface of light-emitting layer 52*a*. LED layer 52*b* is stacked on the front surface of light-emitting layer 52*a*.

LED layer 52*b* is configured as, for example an insulating layer such as a sapphire layer stacked on the front surface of an n-type layer made of, for example, N—GaN. The insulating layer of LED layer 52*b* has an uneven front surface which controls the distribution of emitted light. Cathode electrode 52*d* is formed on the front surface of LED layer 52*b*.

On the mounting surface side of light source 52, the surface on which cathode electrode 52*d* is formed is sunken relative to the surface on which anode electrode 52*c* is formed. In other words, the mounting surface side (rear surface side) of light source 52 has a stepped structure.

Metal pedestal 70 is approximately cuboid in shape, made of metal, and is a sub-mount layer on which light source 52 is stacked. Metal pedestal 70 is formed of, for example, an aluminum nitride material. Cathode pattern 71 and anode pattern 72 are formed arranged on the front surface side of metal pedestal 70.

Cathode electrode 52*d* of light source 52 is disposed so as to face cathode pattern 71, and anode electrode 52*c* of light source 52 is disposed so as to face anode pattern 72. Cathode pattern 71 and cathode electrode 52*d* are connected via Au bump 91, and anode pattern 72 and anode electrode 52*c* are connected via Au bump 92.

As illustrated in (a) and (b) in FIG. 8, cathode electrode 73, anode electrode 74, and two heat dissipating electrodes 75 are formed in an array on the rear surface side of metal pedestal 70. Cathode electrode 73 and anode electrode 74 are aligned in series so as to be adjacent to one another, and heat dissipating electrodes 75 are in non-connection and aligned in series so as to be adjacent to one another. In this embodiment, one cathode electrode 73, one anode electrode 74, and two heat dissipating electrodes 75 are formed on the rear surface of metal pedestal 70, but this example is not limiting. For example, one or three or more heat dissipating electrodes 75 may be formed.

Through-hole 79 that connects cathode pattern 71 and cathode electrode 73 is formed in metal pedestal 70. More specifically, through-hole 79 is structured as a through-hole formed in metal pedestal 70 that is filled with an electrically conductive material, and electrically connects cathode pattern 71 and cathode electrode 73.

As illustrated in FIG. 7, light emitter 50 configured in this manner is electrically connected, via solder 58, to power supply surface 220*a* of electrical line 220 for supplying power with cathode electrode 73 of light emitter 50. Power supply surface 220*a* is an electrode surface for supplying power to light emitter 50, is provided on the side of light emitter 50 opposite the light emitting side of emitter 50, and is electrically connected to cathode electrode 73 of light source 52 (to be described later). Power supply surface 220*a* is arranged in a horizontal direction passing through the approximate center of major surface 250.

Light emitter 50 is provided on electrical line 220 (the region in which light source 52 is placed) of mounting pedestal 200 such that heat dissipating electrodes 75 provided on the mounting surface of light emitter 50 correspond to heat escape port 233 that communicatively connects major surface 250 to plated thin film layer 231*b* of metal layer 231. Heat dissipating electrodes 75 of light emitter 50 and plated thin film layer 231*b* on the bottom of heat escape port 233 are connected together by solder 59 (one example of the joining component). In other words, heat escape port 233 is a communicative path for joining light emitter 50 and plated thin film layer 231*b* of metal layer 231 via solder 59, and heat generated by light source 52 transfers to heat dissipating electrodes 75 and solder 59 and then transfers to plated thin film layer 231*b* of metal layer 231.

In a front view, phosphor 53 has a 0.8 mm by 0.8 mm square shape. Phosphor 53 is housed in housing region 51*a* and disposed on the front surface of light source 52. Phosphor 53 is disposed such that the center lines of light source 52 and phosphor 53 are aligned. The space between phosphor 53 and light source 52 is filled with light-transmissive resin 54. Phosphor 53 is a plate-shaped component containing a wavelength converter that converts the wavelength of a portion of light emitted by light emitter 50. The material used for the wavelength converter is not particularly limited. Examples include known materials such as YAG ($Y_3Al_5O_2$) phosphor, CASN ($CaAlSiN_3$) phosphor, and SiAlON phosphor. Phosphor 53 is formed by dispersing the wavelength converter in a material, such as resin, ceramic, or glass. The rear surface of phosphor 53 is adhered to the front surface of light source 52, which is the light-emission surface, via light-transmissive resin 54. Note that "center lines" refer to the respective lines that pass through the centers of light source 52 and phosphor 53 in a front view of light source 52 and phosphor 53.

Note that in this embodiment, SiAlON phosphor, which has yellow fluorescent characteristics, is used, and the blue light emitted by the blue light source passes through phosphor 53 whereby it is converted by the SiAlON phosphor into yellow light so as to produce an overall artificial white light. Note that white light may be produced by combining a blue light source that emits blue light, a red light source that emits red light, and a green light source that emits green light. Moreover, white light may be produced using another known technique. "Blue light" refers to light that appears blue to the naked eye, and "white light" refers to light at appears white to the naked eye.

Light-transmissive resin 54 is an adhesive for adhering light source 52 and phosphor 53.

Here, unless otherwise stated, among lens tubes 30, first light-transmissive components 41, and second light-transmissive components 42 illustrated in FIG. 3 and FIG. 4, the description will focus on one lens tube 30, one first light-transmissive component 41, and one second light-transmissive component 42. The other lens tubes 30, first light-transmissive components 41, and second light-transmissive components 42 have the same configurations.

As illustrated in FIG. 3 and FIG. 4, lens tube 30 is a black box-shaped chassis that internally reflects light. Lens tube 30 houses therein first light-transmissive component 41. Lens tube 30 has front and rear openings for the light emitted by light emitter 50 to pass through. Moreover, in this embodiment, lens tube 30 has engagement protrusion 31 that protrudes rearward from the rear end surface so as to surround the rear opening. Note that when depression 260 of mounting pedestal 200 is formed as a protrusion, lens tube 30 has a depression that recedes rearward from the rear end surface so as to surround the rear opening.

As illustrated in FIG. 9, engagement protrusion 31 has a shape that corresponds to depression 260 of major surface 250. The positioning of lens tube 30 relative to mounting pedestal 200 is determined by engagement protrusion 31 of lens tube 30 being inserted and engaging with depression 260. Lens tube 30 is then fixed to mounting pedestal 200 with fixing components such as bolts inserted into screw holes 291.

As illustrated in FIG. 3 and FIG. 4, first light-transmissive component 41 is an anteroposteriorly elongated, approximate cuboid light-transmissive component having the function of a lens, and is housed in one-to-one correspondence with each lens tube 30 so as to guide light emitted by light source 52 of light emitter 50 in the direction of travel. First light-transmissive component 41 has a plurality of engagement parts which engage with lens tube 30 such that first light-transmissive component 41 is positioned within lens tube 30. First light-transmissive component 41 mainly includes first surface of incidence 41*a* on which light emitted by light emitter 50 is incident and first exit surface 41*b* from which light passing through first light-transmissive component 41 exits.

First surface of incidence 41*a* is an approximate semi-spherical depression formed to cover the surrounding region of light emitter 50, and is formed on the rear end surface of first light-transmissive component 41. First surface of incidence 41*a* is located in the vicinity of engagement protrusion 31 of lens tube 30. First surface of incidence 41*a* may be located so as to surround the sides of light emitter 50 such that light traveling towards the sides of light emitter 50 is also incident on first surface of incidence 41*a*.

First exit surface 41*b* is the front end surface of first light-transmissive component 41, and is a surface from which light passing through first light-transmissive component 41 exits. First exit surface 41*b* faces second light-transmissive component 42.

Second light-transmissive component 42 has the function of a lens and is provided in one-to-one correspondence with lens tubes 30 so as to cover the front opening. Second light-transmissive component 42 is an approximate cuboid light-transmissive component elongated in the left and right directions and located in front of lens tube 30 (located further in the direction of travel than first light-transmissive component 41). Second light-transmissive component 42 mainly includes second surface of incidence 42*a* on which light emitted from first exit surface 41*b* of first light-transmissive component 41 is incident and second exit surface 42*b* from which light passing through second light-transmissive component 42 exits.

Second surface of incidence 42*a* is a planar surface that covers the front opening of lens tube 30, and is formed on the rear end surface of second light-transmissive component 42. Second surface of incidence 42*a* is located in the vicinity of the front opening of lens tube 30.

Second exit surface 42*b* is the front end surface of second light-transmissive component 42, and is a surface from which light passing through second light-transmissive component 42 exits. Second exit surface 42*b* is rounded into an approximate sphere.

As illustrated in FIG. 3 and FIG. 7, in such a mounting pedestal 200, light source 52 generates heat when operating (emitting light). This heat is transferred to metal pedestal 70 via anode electrode 52*c* of light source 52 and Au bump 91 as well as to metal pedestal 70 via cathode electrode 52*d* of light source 52 and Au bump 92. The heat transferred to metal pedestal 70 is transferred to solder 59 from heat dissipating electrodes 75 of metal pedestal 70, and is then dissipated by metal layer 231 via plated thin film layer 231*b*.

Moreover, with such a mounting pedestal 200, light emitted by light source 52 exits light emitter 50 through phosphor 53 and then is incident on first surface of incidence 41*a* of first light-transmissive component 41. Light incident on first surface of incidence 41*a* passes through first light-transmissive component 41 and then exits first exit surface 41*b* of first light-transmissive component 41. Light that has exited from first exit surface 41*b* is then incident on second surface of incidence 42*a* of second light-transmissive component 42, passes through second light-transmissive component 42, and then exits from second exit surface 42*b*.

With headlight 103 including mounting pedestal 200 and wheeled vehicle 100 including mounting pedestal 200, light is emitted in the direction of travel.

Lens tube 30 of mounting pedestal 200 configured this way is, in this embodiment, 87.69 mm long in the anteroposterior direction, 36 mm wide in the left and right directions, and 20 mm tall in the top-to-bottom direction. Moreover, first light-transmissive component 41 according to this embodiment is 49.15 mm long in the anteroposterior direction, 35 mm wide in the left and right directions, and 16 mm tall in the top-to-bottom direction. Further, second light-transmissive component 42 according to this embodiment is 18.611 mm long in the anteroposterior direction, 36 mm wide in the left and right directions, and 20 mm tall in the top-to-bottom direction. Moreover, when second light-transmissive component 42 is provided on lens tube 30, the length in the anteroposterior direction is 99.79 mm.

Figure 10:
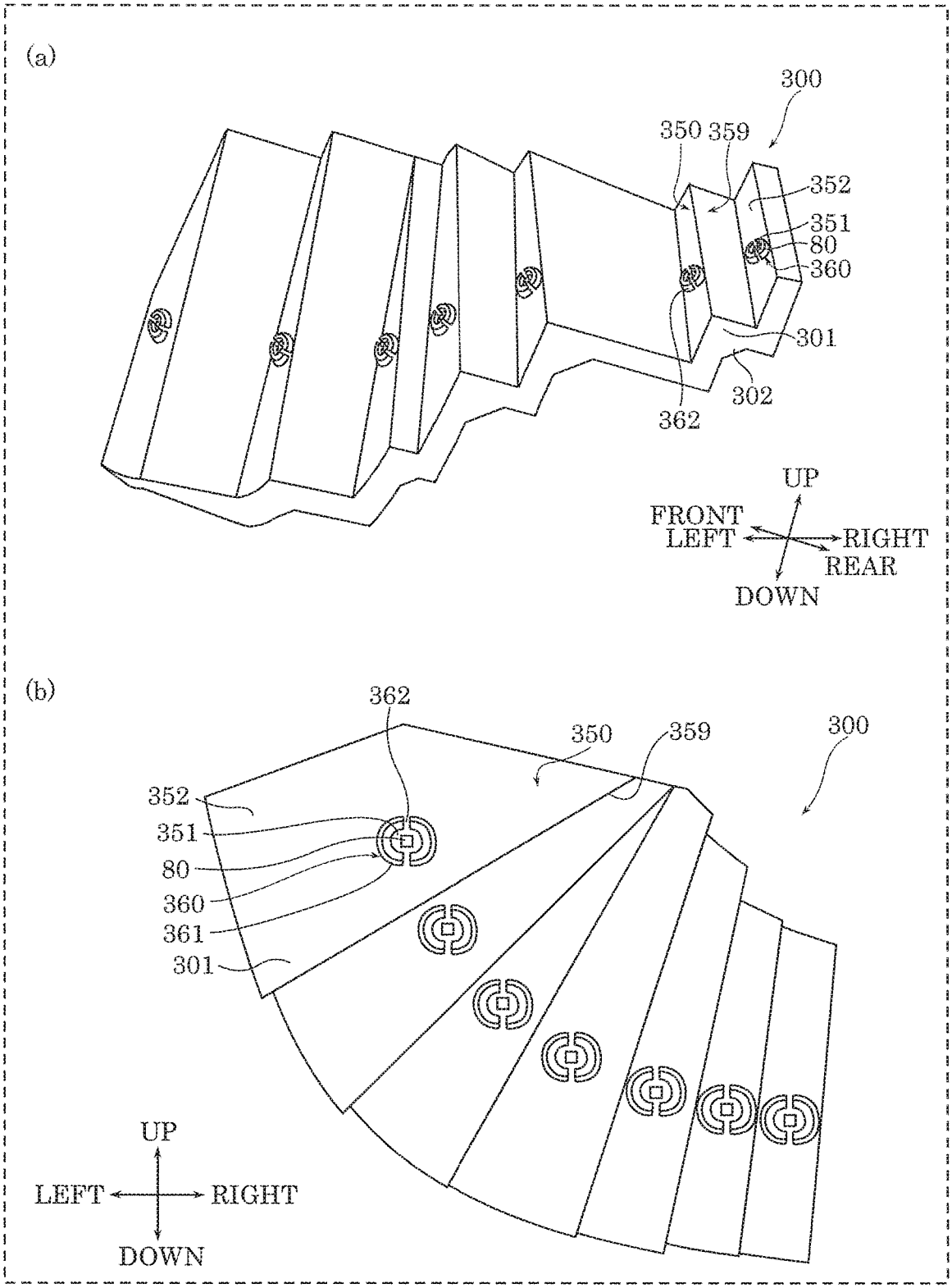
In FIG. 10, (a) illustrates a perspective view of a low-beam mounting pedestal and a light emitter mounted thereto according to an embodiment, and (b) illustrates a side view of a low-beam mounting pedestal and a light emitter mounted thereto according to an embodiment.
Figure 11:
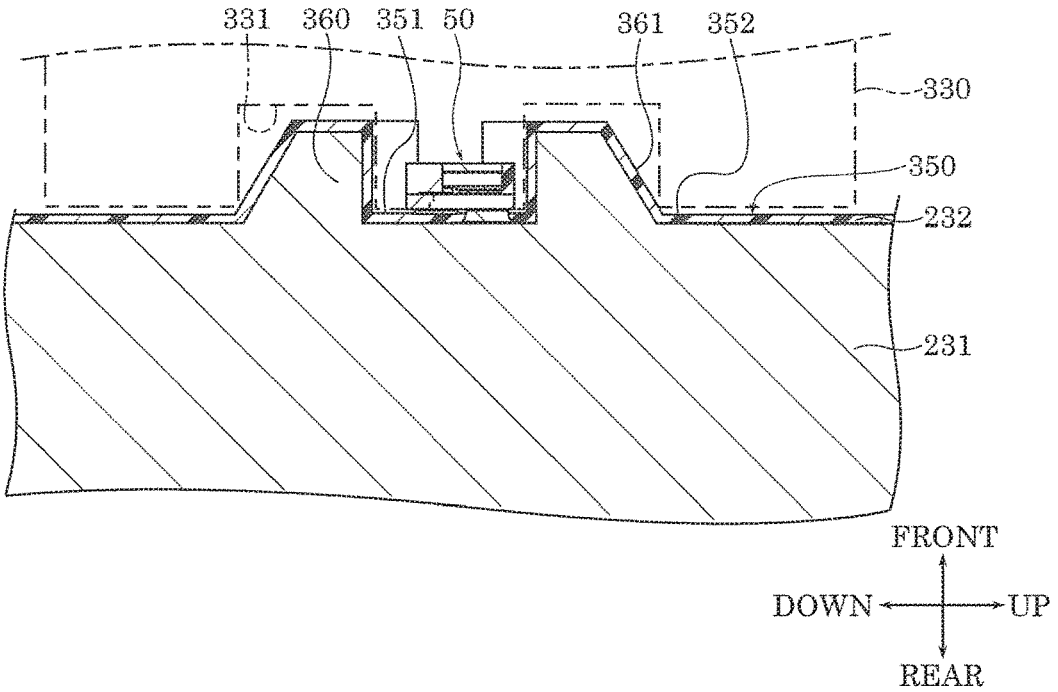
FIG. 11 is an enlarged partial cross sectional view of a mounting pedestal and a light emitter mounted thereto according to an embodiment.

Next, the low-beam light-emitting device 12 will be discussed with reference to (a) and (b) in FIG. 10, and FIG. 11. In FIG. 10, (a) illustrates a perspective view of low-beam mounting pedestal 300 and light emitter 80 mounted thereto according to this embodiment. In FIG. 10, (b) illustrates a side view of low-beam mounting pedestal 300 and light emitter 80 mounted thereto according to this embodiment. FIG. 11 is an enlarged partial cross sectional view illustrating mounting pedestal 300 and light emitter 80 mounted thereto according to this embodiment.

The low-beam light-emitting device 12 has the same configuration as the high-beam light-emitting device 11, but as illustrated in (a) and (b) in FIG. 10, in this embodiment, mounting pedestal 300 used in the low-beam light-emitting device 12 differs from mounting pedestal 200. Depression 260 is formed in mounting pedestal 200, but in mounting pedestal 300, protrusion 360 is formed. Note that both the low-beam light-emitting device 12 and the high-beam light-emitting device 11 may have mounting pedestals having the same shape.

In headlight 103, the low-beam light-emitting device 12 is disposed to the right of the high-beam light-emitting device 11. Similar to the high-beam light-emitting device 11, the low-beam light-emitting device 12 includes, for example, a plurality of lens tubes 330, a plurality of first light-transmissive components 41, a plurality of second light-transmissive components 42, a plurality of light emitters 50, and heat dissipating fins 60.

Mounting pedestal 300 has steps 301. Steps 301 each include major surface 350 facing in the direction of travel of wheeled vehicle 100 in FIG. 1 and step side surface 359 approximately perpendicular to major surface 350. As illustrated in (b) in FIG. 10, major surfaces 350 are arranged in a partial helical shape. In this embodiment, mounting pedestal 300 has a stepped structure configured of six steps 301, and has seven major surfaces 350. Protrusions 360 are formed on mounting pedestal 300, each of which has plane symmetry with depression 260 about major surface 250.

More specifically, two discrete protrusions 360, each of which has a circular arc front view shape, are structured so as to collectively surround a surrounding region of part of light emitter 80. In this embodiment, the two protrusions 360 are disposed so as to have bilateral symmetry. Cutaways 362 are formed between the two protrusions 360. Protrusion 360 has, on its circumferential surface (side surface relative to light emitter 80) inclined surface 361 inclined such that protrusion 360 gradually narrows in outer diameter from major surface 250 toward a tip end of protrusion 360. In other words, inclined surface 231 has a tapered shape.

Each major surface 350 of mounting pedestal 300 includes first planar surface 351 and second planar surface 352. First planar surface 351 is surrounded by two protrusions 360. First planar surface 351 is flush with second planar surface 352 including cutaways 362. Light source 80 is mounted on first planar surface 351.

As illustrated in FIG. 3, lens tube 30 of the high-beam light-emitting device 11 has engagement protrusion 31, but in contrast, as illustrated in FIG. 11, lens tube 330 of the low-beam light-emitting device 12 has engagement depression 331 that recedes from the rear surface toward the front. All other configurations are the same as in lens tube 30. Engagement depression 331 has a shape that corresponds to protrusion 360. The positioning of lens tube 330 relative to mounting pedestal 300 is determined by engagement depression 331 of lens tube 330 being placed on and engaging with protrusion 360. Lens tube 330 is then fixed to mounting pedestal 300 with fixing components such as bolts inserted into screw holes. Note that engagement depression 331 may be formed as through-holes and, alternatively, may be formed as a depression having a bottom.

As illustrated in FIG. 1, one headlight 130 has the symmetrically opposite configuration as the other headlight 130. Moreover, low-beam light-emitting device 12 has the same configuration as high-beam light-emitting device 11.

Figure 12:
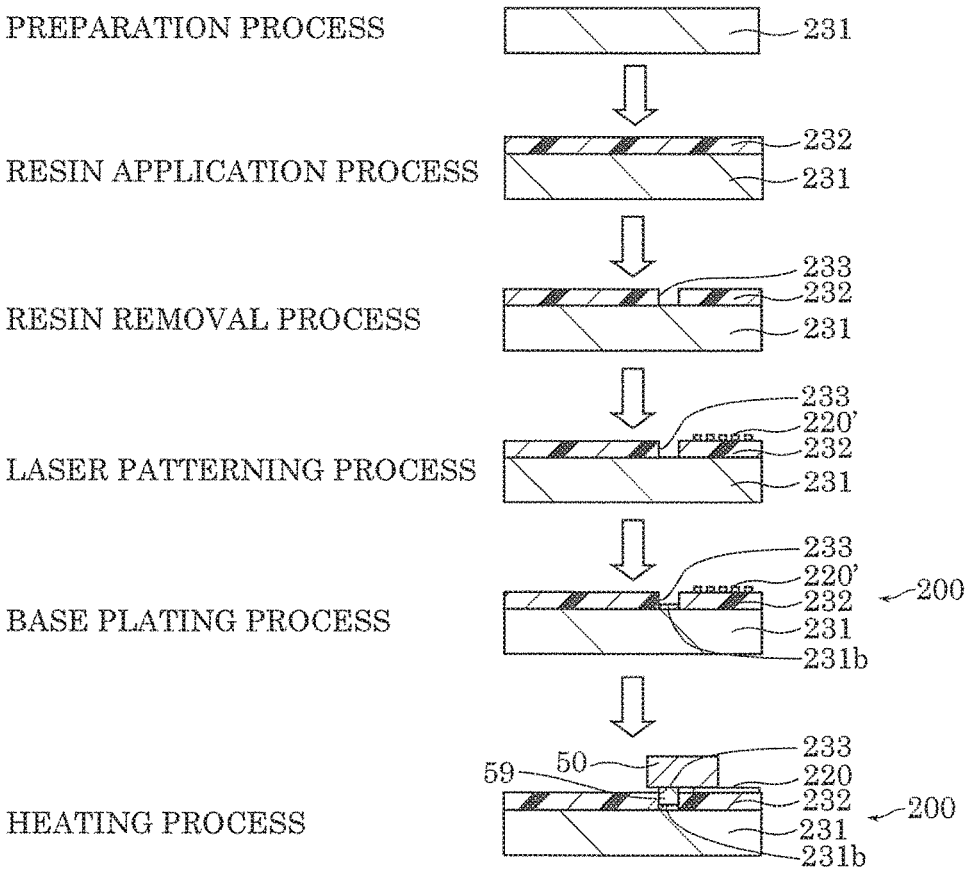
FIG. 12 illustrates manufacturing steps for mounting pedestal 200 according to an embodiment; and In FIG. 13, (a) illustrates a perspective view of a light emitter mounted to a mounting pedestal according to an embodiment, and (b) illustrates an enlarged partial cross sectional view of a mounting pedestal and a light emitter mounted thereto according to an embodiment.

Next, one example of manufacturing steps for manufacturing mounting pedestal 200 configured as described above will be described with reference to FIG. 12. FIG. 12 illustrates manufacturing steps for mounting pedestal 200 according to this embodiment. Note that mounting pedestal 200 has a stepped structure, but in FIG. 12, only part of the stepped structure of mounting pedestal 200 is illustrated; other steps 201 are omitted.

First, an aluminum component (metal layer 231) equal in shape to mounting pedestal 200 to be used as the foundation for metal layer 231 of mounting pedestal 200 is prepared.

Next, a resin and a complex are prepared, and the resin and the complex, which is a metal alloy of metal, oxygen, and nitrogen, are kneaded into pellets. Then, a resin application processes is performed in which a component corresponding to metal layer 231 is filled in a metal cavity, and the pellets are dispensed so as to cover the component corresponding to metal layer 231. This yields a stacked component of metal layer 231 and insulating layer 232.

Next, a resin removal process is performed to form heat escape port 233 by projecting laser light onto insulating layer 232 to expose a portion of metal layer 231 from the component yielded in the resin application process. Heat escape port 233 is formed in the vicinity of power supply surface 220*a* of electrical line 220 in the region in which light emitter 50 is arranged. In other words, heat escape port 233 is a hole having a bottom that exposes metal layer 231 from insulating layer 232. Note that heat escape port 233 may be provided in two locations so as to correspond to the two heat dissipating electrodes 75, but one heat escape port 233 may be formed. The same also applies when three or more heat dissipating electrodes 75 are provided. Note that in this embodiment, as one example, heat escape port 233 is formed using laser light, but the method of forming heat escape port 233 is not limited to this example, and may be formed using, for example, a mask. Note that heat escape port 233 may be formed by forming insulating layer 232 using a catalyst.

Next, a laser patterning process is performed in which laser light is projected onto the region in which electrical line 220 is to be formed to form a circuit. In this laser patterning process, the metal core is exposed from the complex included in insulating layer 232.

Next, a base plating process is performed in which an electroless nickel is stacked on the bottom of heat escape port 233 on the component yielded via the resin removal processes. In this way, nickel and copper plated thin film layer 231*b* stacked on the nickel are formed only on the bottom of heat escape port 233.

Next, a circuit forming processes is performed in which a circuit configured of, stacked in the listed order, the electroless copper plating, electrolytic copper plating, electrolytic nickel plating, and electrolytic gold plating, is formed in the patterned region of the component on which the laser patterning process was performed. Moreover, at the same time as the circuit forming processes performed on the patterned region, a circuit forming process is performed in which a circuit configured of, stacked in the listed order, electrolytic copper plating, electrolytic nickel plating, and electrolytic gold plating, is formed on plated thin film layer 231*b* formed in the base plating process. This yields mounting pedestal 200. Here, a method using the complex included in insulating layer 232 was described, but the method is not limited to a method of, for example, forming a circuit using a catalyst with plating. For example, a known circuit forming method may be used. For example, the circuit may be formed on insulating layer 232 by mask patterning.

Next, solder 59 is applied to heat escape port 233 and power supply surface 220*a* of electrical line 220, and light emitter 50 is mounted. Then, by performing a heating process for heating the component yielded in the component mounting step with a forge, light source 52 is mounted on mounting pedestal 200. Note that the manufacturing steps for manufacturing mounting pedestal 300 are the same as above. Here, the base plating process performed in heat escape port 233 is described as forming the base plating only in heat escape port 233, but even if the base plating is formed on the entire metal layer 231 surface, it goes without saying that heat generated by light source 80 can be effectively dissipated.

Note that one example of the manufacturing steps for mounting pedestal 200 was given, but the manufacturing method is not limited to these steps; mounting pedestal 200 may be manufactured using a known method.

(Working Effects)

Next, the working effects of mounting pedestal 200 according to this embodiment will be described.

As described above, mounting pedestal 200 according to this embodiment is disposed on wheeled vehicle 100, and light emitter 50 is mounted to mounting pedestal 200. Mounting pedestal 200 includes metal layer 231 and insulating layer 232 stacked on metal layer 231. Moreover, insulating layer 232 has major surface 250 facing in the direction of travel of wheeled vehicle 100 and heat escape port 233 in which solder 58 that joins light emitter 50 and metal layer 231 is disposed. Mounting pedestal 200 has a plurality of steps 201 which arrange major surface 250 into a plurality of major surfaces 250.

When light source 52 including an n electrode bump and a p electrode bump is mounted on a typical pedestal using a conventional method, heat dissipates from the n and p electrode bumps, but since insulating layer 232 is formed between (i) the n and p electrode bumps and (ii) metal layer 231, heat does not easily dissipate from light source 52. However, with the present configuration, heat escape port 233 in which solder 59 for joining metal pedestal 70 and metal layer 231 is disposed is formed in insulating layer 232. As such, heat generated by light source 52 is transferred to and dissipated by light source 52, Au bumps 91 and 92, metal pedestal 70, solder 59, plated thin film layer 231*b*, and metal layer 231.

Moreover, with a conventional pedestal, when a high output light source 52 is used, in order to dissipate the heat generated by light source 52, restrictions regarding fastening the pedestal using screws, for example, arise, thereby limiting the freedom of arrangement of pedestals, but with mounting pedestal 200, compared to conventional pedestals, since the heat dissipation ability is high, restrictions regarding fastening using screws, for example, are less likely to occur. Accordingly, compared to conventional pedestals, mounting pedestals 200 can be more freely arranged, making it possible to produce designs in shapes suitable for the moving body.

Therefore, with mounting pedestal 200, there is a greater degree of freedom with regard to design of the moving body and heat generated by light source 52 can be efficiently dissipated.

In particular, pedestals having a low heat dissipating ability are difficult to use with high output light sources 52, but since mounting pedestal 200 has a higher heat dissipating ability than, for example, a conventional flexible substrate, mounting pedestal 200 can be used in a high output headlight 103.

Moreover, with mounting pedestal 200, even if the weight is reduced to $1/5^{th}$ of that of a conventional flexible substrate, equivalent heat dissipating efficacy can be achieved. Accordingly, when mounting pedestal 200 is applied to, for example, a moving body, the weight of the moving body can also be reduced.

Further, with mounting pedestal 200, unlike a conventional flexible substrate, since there is no need to perform, for example, an adhesive application process after mounting the light sources to the flexible substrate and performing a reflow process, the number of steps in the manufacturing process can be reduced. Accordingly, when mounting pedestal 200 is applied to, for example, a moving body, the manufacturing cost of the moving body can be reduced.

Moreover, with mounting pedestal 200, plated thin film layer 231*b* of heat escape port 233 is formed and stacked plating configured of, stacked in the listed order, electroless copper plating, electrolytic nickel plating, electrolytic gold plating, is formed in the region patterned in the laser patterning process. Accordingly, compared to a pedestal in which nickel plating is formed between metal layer 231 and insulating layer 232, manufacturing costs can be decreased.

Moreover, headlight 103 according to this embodiment includes a plurality of mounting pedestals 200. Moreover, the moving body according to this embodiment includes mounting pedestal 200.

The same working effects are achieved with these configurations as well.

Moreover, mounting pedestal 200 according to this embodiment further includes electrical line 220 disposed on a side of light emitter 50 opposite a light emitting side of light emitter 50 and having power supply surface 220*a* that supplies power to light source 52 of light emitter 50. Power supply surface 220*a* is offset from heat escape port 233 in an approximately vertical direction.

With this configuration, since power supply surface 220*a* is disposed below heat escape port 233, even if the positioning of light emitter 50 were to shift in the left and right directions due the counterbore of heat escape port 233, compared to if light emitter 50 were to shift up or down, there is more allowance in shifts in the optical axis of light emitter 50.

Moreover, in mounting pedestal 200 according to this embodiment, in a front view of major surfaces 250, in order in the direction of travel, each major surface 250 is closer to being parallel to a plane approximately perpendicular to the direction of travel than the preceding major surface 250.

With this configuration, upon mounting light emitter 50 to mounting pedestal 200, light emitter 50 is arranged such that its optical axis spreads about the direction of travel in the left and right directions. As such, when mounting pedestal 200 is used, headlight 103 can easily produce a wide distribution of light.

Moreover, mounting pedestal 200 (300) according to this embodiment further includes depression 260 (or protrusion 360) formed in a surrounding region of light emitter 50 (80). Major surface 250 (350) includes first planar surface 251 (351) on which light emitter 50 (80) is mounted and that is partially surrounded by depression 260 (or protrusion 360), and second planar surface 252 (352) in areas other than first planar surface 251 (351). First planar surface 251 (351) and second planar surface 252 (352) are flush. Electrical line 220 is formed on first planar surface 251 (351) and second planar surface 252 (352).

With this configuration, since first planar surface 251 and second planar surface 252 are flush, when forming electrical line 220 extending from second planar surface 252 to first planar surface 251, electrical line 220 can be formed on first planar surface 251 via bridge 262 on which second planar surface 252 is formed, and not via depression 260. With this configuration, the line is less likely to break compared to when electrical line 220 is formed in depression 260.

Moreover, with this configuration, since first planar surface 351 and second planar surface 352 are flush, when forming electrical line 220 extending from second planar surface 352 to first planar surface 351, electrical line 220 can be formed on first planar surface 351 via in cutaways 362 on which second planar surface 352 is formed, and not via protrusion 360. With this configuration, the line is less likely to break compared to when electrical line 220 is formed on protrusion 360.

Moreover, in mounting pedestal 200 used in the high-beam light-emitting device 11 according to this embodiment, depression 260 engages with lens tube 30 and has inclined surface 261 inclined such that depression 260 gradually narrows from the opening of depression 261 toward the bottom of depression 260.

With this configuration, when fixing lens tube 30 including first light-transmissive component 41 and second light-transmissive component 42 to mounting pedestal 200, positioning is easier to do. Accordingly, lens tube 30 can be precisely fixed to mounting pedestal 200, making the optical axis of light emitter 50 that passes through first light-transmissive component 41 and second light-transmissive component 42 less likely to deviate from the desired direction.

Moreover, in mounting pedestal 300 used in the low-beam light-emitting device 12 according to this embodiment, protrusion 360 has inclined surface 361 inclined such that protrusion 360 gradually narrows in outer diameter from major surface 350 toward a tip end of protrusion 360.

With this configuration, when fixing lens tube 330 including first light-transmissive component 41 and second light-transmissive component 42 to mounting pedestal 300, positioning is easier to do. Accordingly, lens tube 330 can be precisely fixed to mounting pedestal 300, making the optical axis of light emitter 80 that passes through first light-transmissive component 41 and second light-transmissive component 42 less likely to deviate from the desired direction.

Moreover, in mounting pedestal 200 according to this embodiment, in a front view of major surfaces 250, in order in the direction of travel, each light emitter 50 optical axis is closer to being parallel to the direction of travel than the optical axis of the preceding light emitter 50.

With this configuration, light emitting from headlight 103 of wheeled vehicle 100 can have a wide distribution in the left and right directions about the direction of travel.

Moreover, mounting pedestal 200 according to this embodiment further includes ribs 202 disposed on the rear surface of mounting pedestal 200, in positions corresponding to steps 201, the rear surface and steps 201 being on opposite sides of mounting pedestal 200.

With this configuration, since ribs 202 are formed in the corners of the steps on the rear surface of mounting pedestal 200, the strength of mounting pedestal 200 can be secured.

Moreover, mounting pedestal 200 according to this embodiment further includes heat dissipating fins 60 disposed on the rear surface of mounting pedestal 200 and extending approximately vertically, the rear surface and steps 201 being on opposite sides of mounting pedestal 200.

With this configuration, since heat dissipating fins 60 extend in a direction approximately perpendicular to the alignment direction, natural convection current can easily pass in an upward direction from the rear surface of mounting pedestal 200. Accordingly convection of heat on the rear surface of mounting pedestal 200 does not easily occur. As a result, compared to heat dissipating fins 60 that extend in a direction approximately parallel to the alignment direction, heat dissipating fins 60 can easily dissipate heat on the rear surface of mounting pedestal 200.

Moreover, mounting pedestal 200 according to this embodiment is elongated and curves in the alignment direction of major surfaces 250.

With this configuration, mounting pedestal 200 can be suited to a variety of moving bodies. Accordingly, design freedom can be increased when mounting pedestal 200 is used.

Moreover, mounting pedestal 200 according to this embodiment further includes connector 270 connectable to an adjacent mounting pedestal 200.

With this configuration, by connecting a plurality of mounting pedestals 200 together, mounting pedestals 200 can be arranged in three dimensions in accordance with the structure of the moving body. Accordingly, design freedom can be further increased when mounting pedestal 200 is used.

Moreover, in mounting pedestal 200 according to this embodiment, connector 270 is disposed at an end region of mounting pedestal 200.

With this configuration, adjacent mounting pedestals 200 are easily connectable.

Light-emitting device 11 (12) according to this embodiment includes: mounting pedestal 200; light emitter 50 that emits light; lens tube 30 that reflects light; and first light-transmissive component 41 that is disposed in lens tube 30 and guides, in approximately the direction of travel, the light emitted by light emitter 50.

With this configuration, light is guided in approximately the direction of travel by first light-transmissive component 41 and lens tube 30. As such, light with a high degree of directionality relative to the direction of travel of wheeled vehicle 100 can be emitted from headlight 103.

Moreover, light-emitting device 11 (12) according to this embodiment further includes second light-transmissive component 42 that focuses light and is disposed on lens tube 30, in a location further in the direction of travel than first light-transmissive component 41.

With this configuration, for example, since light emitted from first exit surface 41*b* of first light-transmissive component 41 is focused and emitted from second exit surface 42*b* of second light-transmissive component 42, light with an even higher degree of directionality relative to the direction of travel of wheeled vehicle 100 can be emitted from headlight 103.

Note that since the low-beam light-emitting device 12 and mounting pedestal 300 used in light-emitting device 12 also achieve the same working effects, specific description thereof is omitted unless particularly pointed out.

Moreover, mounting pedestal 200, 300 according to this embodiment on which light emitters 50 may be mounted, includes metal layer 231 and insulating layer 232 stacked on metal layer 231. Metal layer 231 and insulating layer 232 are arranged in a stepped structure which includes a plurality of steps 201 each having major surface 250. Major surface 250 of each of the plurality of steps 201 is configured to receive and provide power to a corresponding light emitter 50, and insulating layer 232 on each of the plurality of steps 201 includes heat escape port 233 in which solder 58 that joins light emitter 50 and metal layer 231 can be disposed.

Moreover, a headlight according to this embodiment includes: housing 110 configured to be mounted to a front of a vehicle 100; a mounting pedestal located within housing 110 on which a plurality of light emitters 50 are mounted. The Mounting pedestal includes metal layer 231 and insulating layer 232 stacked on metal layer 231. Metal layer 231 and insulating layer 232 are arranged in a stepped structure which includes a plurality of steps 201 each having major surface 250. Major surface 250 of each of the plurality of steps 201 includes a corresponding light emitter 50 from among the plurality of light emitters 50 mounted thereto, and is configured to provide power to the corresponding light emitter 50. Insulating layer 232 on each of the plurality of steps 201 includes heat escape port 233 in which solder 58 that joins light emitter 50 and metal layer 231 is disposed.

(Other Variations, Etc.)

Hereinbefore, the present disclosure has been described based on an embodiment, but the present disclosure is not limited to the embodiment.

For example, in the above embodiment, each major surface may be randomly arranged on the mounting pedestal so as to be approximately parallel to or intersecting a plane approximately perpendicular to the direction of travel. Moreover, each side surface may be arranged on the mounting pedestal so as to be randomly either approximately parallel to a vertical direction or intersecting a vertical direction.

Moreover, in the above embodiment, (b) in FIG. 2 illustrates an enlarged partial perspective view of a headlight of a moving body according to a variation. In FIG. 2, (c) illustrates an enlarged partial perspective view of a headlight of a moving body according to a variation.

As illustrated in (b) in FIG. 2, headlight 103 includes a plurality of high-beam light-emitting devices 411 and a plurality of low-beam light-emitting devices 412. Utilizing the mounting pedestals, light-emitting devices 412 can be arranged in matrix, as illustrated in (b) in FIG. 2. As illustrated in (c) in FIG. 2, headlight 103 includes a plurality of high-beam light-emitting devices 511 and a plurality of low-beam light-emitting devices 512. Utilizing the mounting pedestals, light-emitting devices 412 can be arranged as illustrated in (c) in FIG. 2. Note that the shape of the mounting pedestal can be modified arbitrarily in accordance with a desired shape for the moving body.

Figure 13:
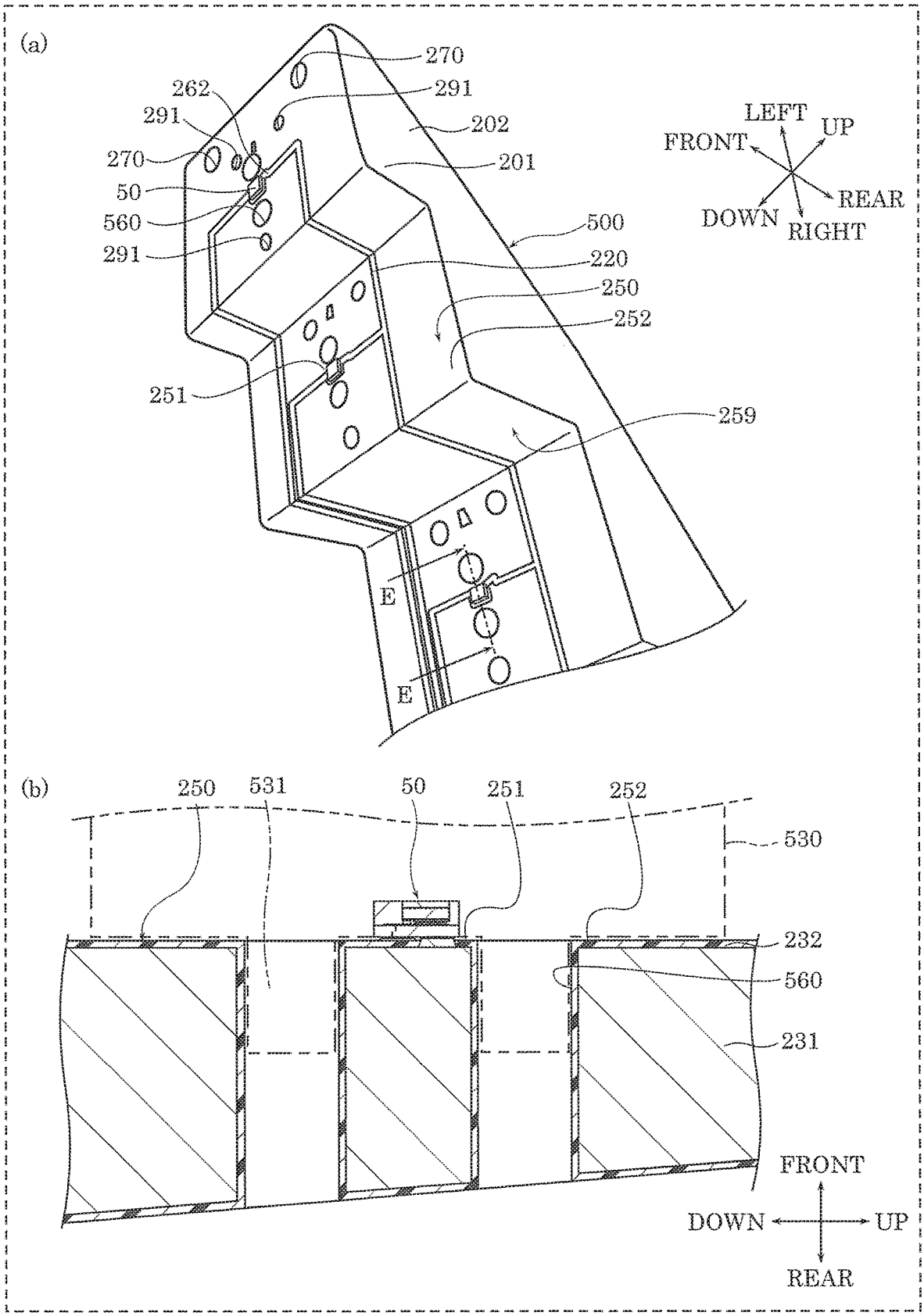

In FIG. 13, (a) is a perspective view of light emitter 50 mounted to mounting pedestal 500 according to an embodiment. In FIG. 13, (b) is an enlarged partial cross sectional view illustrating mounting pedestal 500 and light emitter 50 mounted thereto according to an embodiment. The cross section in (b) in FIG. 13 is taken at line E-E in (a) in FIG. 13.

Depressions 260 included in mounting pedestal 200 according to an embodiment are depressions having bottoms, but may be realized as through-holes 560 (one example of the depression) illustrated in (a) and (b) in FIG. 13. Through-holes 560 are disposed in the surrounding region of each light emitter 50. More specifically, each through-hole 560 passes through mounting pedestal 500, from major surface 250 to the rear surface. Note that each through-hole 560 is circular in a front view, but may be elliptical, rectangular, etc. Inclined surface 261 illustrated in FIG. 9 need not be formed in through-hole 560, and is not an essential component.

In such cases, engagement protrusions 531 of each lens tube 530 are formed so as to correspond to through-holes 560. Each engagement protrusion 531 is a protrusion having a columnar shape that corresponds to the shape of through-hole 560. In other words, each engagement protrusion 531 may be a shape that corresponds to the shape of through-hole 560, such as circular, elliptical, rectangular, etc. in a front view. Moreover, among a pair of through-holes 560, one through-hole 560 may be circular in shape and the other through-hole 560 may be elliptical in shape, and engagement protrusions 531 of lens tube 530 may be circular in shape. In such cases, lens tube 530 can be easily positioned relative to mounting pedestal 500, and through-holes 560 and engagement protrusions 531 are easy to manufacture, thereby inhibiting sudden increases in manufacturing costs.

Moreover, in the above embodiment, the power supply surface may be disposed horizontally offset from the heat escape port. In other words, the power supply surface may be disposed to the left or right of the heat escape port.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A mounting pedestal disposed on a moving body and on which a light emitter is mounted, the mounting pedestal comprising:

a metal layer; and an insulating layer stacked on the metal layer, wherein the insulating layer has a major surface facing in a direction of travel of the moving body and a heat escape port in which a joining component that joins the light emitter and the metal layer is disposed, and the mounting pedestal has a step which arranges the major surface into a plurality of major surfaces.

2. The mounting pedestal according to claim 1, further comprising an electrical line disposed on a side of the light emitter opposite a light emitting side of the light emitter and having a power supply surface that supplies power to the light emitter, wherein the power supply surface is offset from the heat escape port in an approximately vertical direction.

3. The mounting pedestal according to claim 2, further comprising one of a depression and a protrusion formed in a surrounding region of the light emitter, wherein the major surface includes a first planar surface on which the light emitter is mounted, the first planar surface being partially surrounded by the one of the depression and the protrusion, and a second planar surface in areas other than the first planar surface, the first planar surface and the second planar surface are flush, and the electrical line is formed on the first planar surface and the second planar surface.

4. The mounting pedestal according to claim 3, wherein the depression is configured to engage a lens tube and has an inclined surface inclined such that the depression gradually narrows from an opening of the depression toward a bottom of the depression.

5. The mounting pedestal according to claim 3, wherein the protrusion has an inclined surface inclined such that the protrusion gradually narrows in outer diameter from the major surface toward a tip end of the protrusion.

6. The mounting pedestal according to claim 1, wherein among the plurality of major surfaces, a major surface arranged further ahead in the direction of travel forms a smaller angle with a plane perpendicular to the direction of travel than a major surface arranged further behind in the direction of travel.

7. The mounting pedestal according to claim 1, wherein the light emitter includes a plurality of light emitters, each light emitter is disposed on a respective one of the plurality of major surfaces, and among the plurality of light emitters, a light emitter disposed further ahead in the direction of travel has an optical axis which forms a smaller angle with the direction of travel than a light emitter disposed further behind in the direction of travel.

8. The mounting pedestal according to claim 1, further comprising a rib disposed on a rear surface of the mounting pedestal, in a position corresponding to the step, the rear surface and the step being on opposite sides of the mounting pedestal.

9. The mounting pedestal according to claim 1, further comprising a heat dissipating fin disposed on a rear surface of the mounting pedestal and extending vertically, the rear surface and the step being on opposite sides of the mounting pedestal.

10. The mounting pedestal according to claim 1, wherein the mounting pedestal is elongated and curves in an alignment direction of the plurality of major surfaces.

11. The mounting pedestal according to claim 1, further comprising a connector connectable to an adjacent mounting pedestal.

12. The mounting pedestal according to claim 11, wherein the connector is disposed at an end region of the mounting pedestal.

13. A light-emitting device, comprising:

the mounting pedestal according to claim 1;

a light emitter that emits light;

a lens tube that reflects light; and a first light-transmissive component that is disposed in the lens tube and guides, in approximately the direction of travel, the light emitted by the light emitter.

14. The light-emitting device according to claim 13, further comprising a second light-transmissive component that focuses light and is disposed on the lens tube, in a location further in the direction of travel than the first light-transmissive component.

15. A moving-body lighting device, comprising the mounting pedestal according to claim 1 in plurality.

16. A moving body, comprising the mounting pedestal according to claim 1.

17. A mounting pedestal on which light emitters may be mounted, comprising:

a metal layer; and an insulating layer stacked on the metal layer, wherein the metal layer and insulating layer are arranged in a stepped structure which includes a plurality of steps each having a major surface, the major surface of each of the plurality of steps is configured to receive and provide power to a corresponding light emitter, and the insulating layer on each of the plurality of steps includes a heat escape port in which a joining component that joins the light emitter and the metal layer is disposed.

18. A headlight, comprising:

a housing configured to be mounted to a front of a moving body;

a mounting pedestal located within the housing on which a plurality of light emitters are mounted, the mounting pedestal comprising:

a metal layer; and an insulating layer stacked on the metal layer, wherein the metal layer and the insulating layer are arranged in a stepped structure which includes a plurality of steps each having a major surface, the major surface of each of the plurality of steps includes a corresponding light emitter from among the plurality of light emitters mounted thereto, and is configured to provide power to the corresponding light emitter, and the insulating layer on each of the plurality of steps includes a heat escape port in which a joining component that joins the light emitter and the metal layer is disposed.

* * * * *